US006338328B1

(12) United States Patent
Mower et al.

(10) Patent No.: US 6,338,328 B1
(45) Date of Patent: Jan. 15, 2002

(54) CRANKCASE INDUCTED SELF-SUPERCHARGING FOUR CYCLE INTERNAL COMBUSTION ENGINE

(76) Inventors: Louis W. Mower; Konrad L. Mower, both of P.O. Box 672109, Chugiak, AK (US) 99567

( * ) Notice: Subject to any disclaimer, the term of this patent is extended or adjusted under 35 U.S.C. 154(b) by 0 days.

(21) Appl. No.: 09/733,408

(22) Filed: Dec. 5, 2000

(51) Int. Cl.[7] ..... F02B 75/02
(52) U.S. Cl. ..... 123/317; 123/318
(58) Field of Search ..... 123/317, 318

(56) References Cited

U.S. PATENT DOCUMENTS 1,420,266 A * 6/1922 Knox ..... 123/318

FOREIGN PATENT DOCUMENTS

GB 2130641 * 6/1984 ..... 123/318

* cited by examiner

*Primary Examiner*—Noah P. Kamen
(74) *Attorney, Agent, or Firm*—Michael J. Tavella

(57) ABSTRACT

A crankcase inducted self-supercharging four-cycle internal combustion engine that uses cylinder pairs as an induction pump. The cylinder pairs are arranged in a 360-degree crank throw so that both pistons rise and fall together. The cylinders are synchronized so that when one cylinder is on the intake stroke, the other is on the power stroke. A two-cycle reed valve is installed on a crankcase inlet port to draw air into the crankcase on the upstroke of the pistons. Since both pistons rise and fall together, each upstroke draws a volume of air equal to the volume of two pistons into the crankcase. When both pistons are on the down stroke, this air is compressed and, then moved into a manifold connecting the crankcase to the inlet valves of the cylinders. Thus, it is possible to double the air available for each cylinder without using storage tanks or other devices.

7 Claims, 6 Drawing Sheets

CRANKCASE INDUCTED SELF-SUPERCHARGING FOUR CYCLE INTERNAL COMBUSTION ENGINE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to self supercharging internal combustion engines and particularly to crankcase inducted self-supercharging four-cycle internal combustion engine.

2. Description of Related Art

Several patents have been issued relating to the use of the crankcase as an air chamber to enhance combustion air in an engine. These patents cover both two stroke and four stroke engines. For example, U.S. Pat. No. 3,973,532 to Litz uses a sealed crankcase to draw air into the engine. This air is then compressed and stored in a holding tank, where it is drawn into the cylinder on the intake stroke. This compressed air supercharges the fuel mixture before the normal compression stroke. One problem with this design is that it requires a separate sir tank to be added to the engine. Another problem is that it only draws a single charge of air over two of the cycles. While this does provide additional air, it does so inefficiently.

U.S. Pat. No. 5,377,634 to Taue teaches another engine that uses the crankcase as a compression chamber for air. Again, the problem is that the chamber is small and the amount of air being compressed and pumped is limited by what one cylinder can pump and compress. U.S. Pat. Nos. 5,230,314, 5,657,724, 4,282,845, and 4,545,346 all teach use of a crankcase as a compression chamber to compress air for combustion. They all suffer from the same volume limitations that limit the amount of air that can be compressed to that produced by one cylinder.

U.S. Pat. No. 5,105,775 takes the use of the crankcase combustion chamber in a slightly different direction. Here, the crankcase is divided into a number of sealed chambers. Adjacent chambers are interconnected. Because of the timing differences between the cylinders, this allows one cylinder to charge the other cylinder and vice versa. This then eliminates the need for a separate holding tank, because each cylinder's crankcase acts as the holding tank for the other. Despite the reduction in equipment needed, the fundamental limitation remains in that the air being compressed remains that volume that can be handled by one cylinder.

BRIEF SUMMARY OF THE INVENTION

The instant invention is a crankcase inducted self-supercharging four-cycle internal combustion engine that uses cylinder pairs to as an induction pump. The cylinder pairs are arranged in a 360-degree crank throw so that both pistons rise and fall together. The cylinders are synchronized so that when one cylinder is on the intake stroke, the other is on the power stroke. When one cylinder is on the exhaust stroke, the other is on the compression stroke.

A two-cycle reed valve is installed on a crankcase inlet port to draw air into the crankcase on the upstroke of the pistons. Since both pistons rise and fall together, each upstroke draws a volume of air equal to the volume of two pistons into the crankcase. When both pistons are on the down stroke, this double volume of air is then moved into a manifold connecting the crankcase to the inlet valves of the cylinders. This air is then pumped into each cylinder alternately on each intake stroke. In this way, it is possible to increase the air available for each cylinder by a factor of two without having to resort to storage tanks or other devices. Moreover, there is no wasted movement in compressing the air because each intake stroke draws in twice the volume of one cylinder. The double volume of air is then delivered into one cylinder, which automatically compresses the air in the cylinder without having to store it or compress it separately.

DETAILED DESCRIPTION OF THE INVENTION

Figure 1:
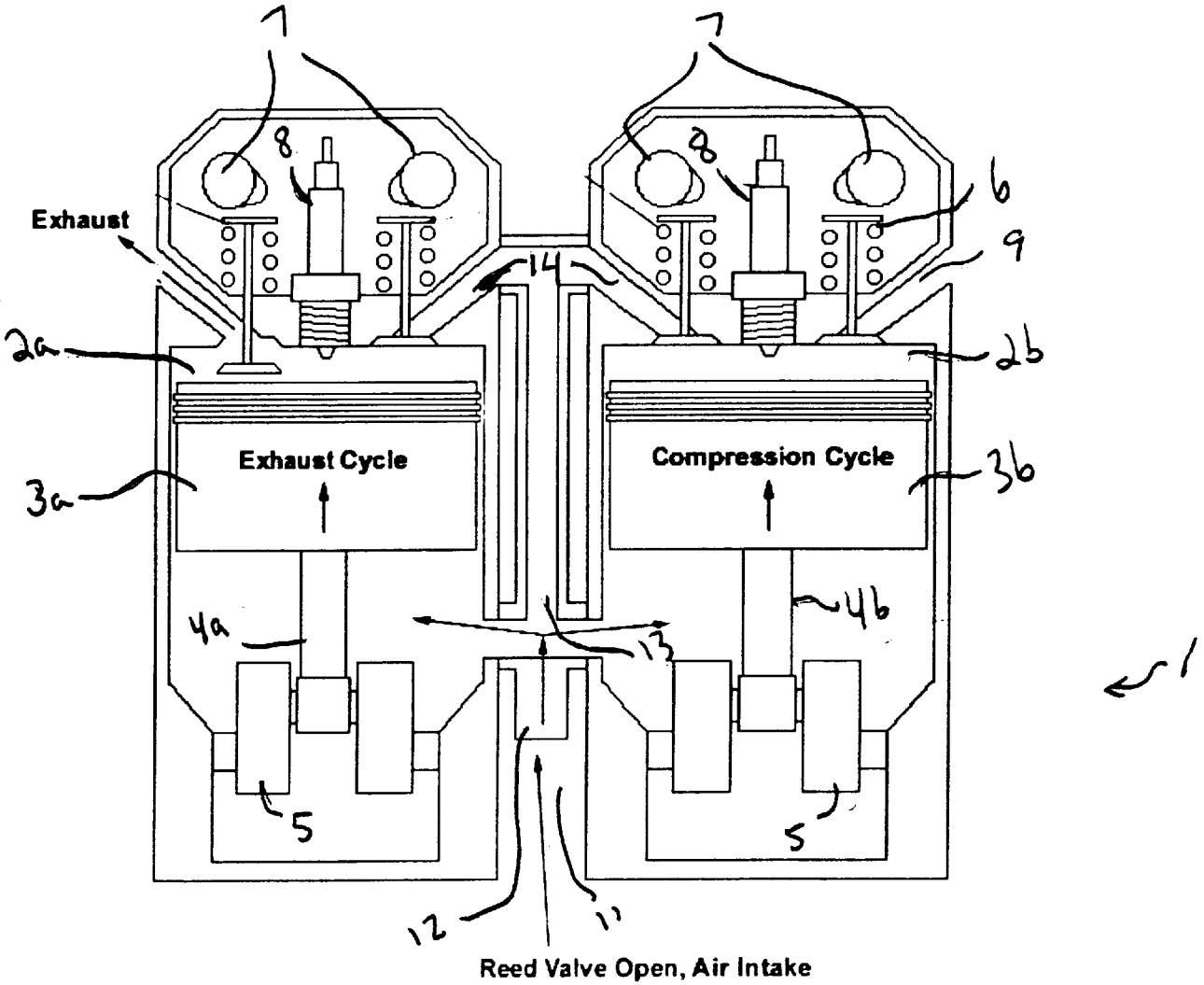
FIG. 1 is a cross-sectional front view of a pair of cylinders showing the pistons moving upward as part of the exhaust and compression cycles.

Referring now to FIG. 1, a cylinder pair 1 is shown. The cylinder pair 1 has two piston chambers, designated as 2*a* and 2*b*. In each piston chamber is a piston, designated as 3*a* and 3*b*. Each piston is connected to a crank 5 with connecting rods 4*a* and 4*b*. The upper portion of each piston chamber has intake and exhaust valves 6 cams 7 and a spark plug 8, which are common to the art. Each piston chamber has an exhaust outlet 9 as well.

At the lower end of the cylinder pair 1 is a crankcase chamber 10. As shown, this chamber extends under both pistons. At the center of the crankcase chamber is an inlet port 11 and a reed valve 12. An inlet tube 13 also rises from the crankcase chamber to the top of the cylinder pair. This tube then bifurcates to form the inlet ports 14 for the each piston chamber.

FIG. 1 shows both pistons moving upward. Piston chamber 2*a* is in the exhaust stroke while piston chamber 2*b* is in the compression stroke. At this time, the reed valve 12 opens, allowing air to flow into the crankcase chamber. Because the intake valves are closed, the air is trapped in the crankcase chamber.

Figure 2:
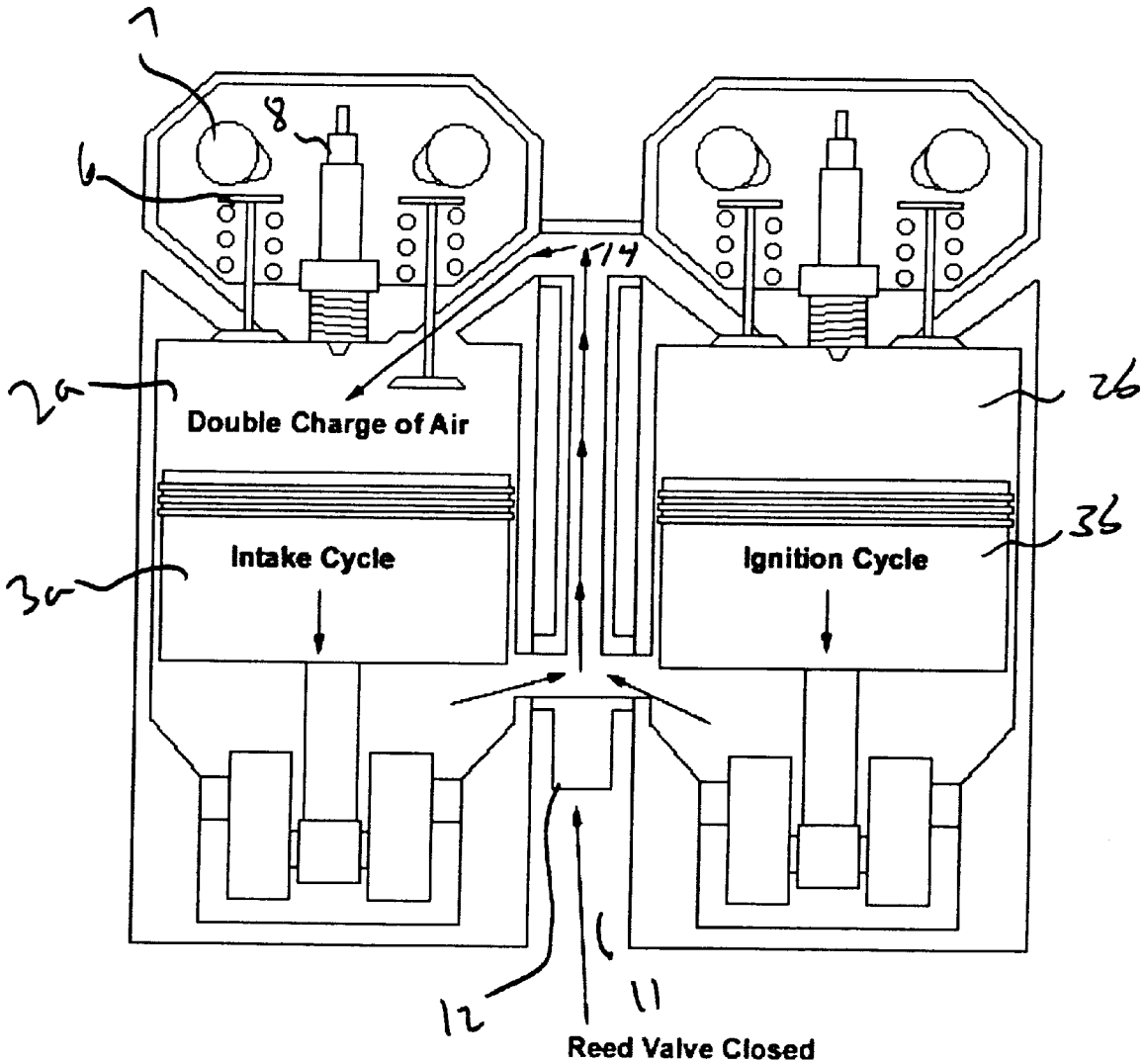
FIG. 2 is a cross-sectional front view of a pair of cylinders showing the pistons moving downward as part of the intake and ignition cycles.

FIG. 2 shows the next step in the cycle. Here, Piston chamber 2*b* has fired and is in the power stroke. Piston chamber 2*a* is in the intake stroke. As the pistons move downward, they compress the air in the crankcase chamber and, because the intake valve of piston chamber 2*a* is opened, they force the entire volume of air from the crankcase chamber into piston chamber 2*a*. This produces a double charge of air in piston chamber 2*a*. As shown, the reed valve is closed during this cycle.

Figure 3:
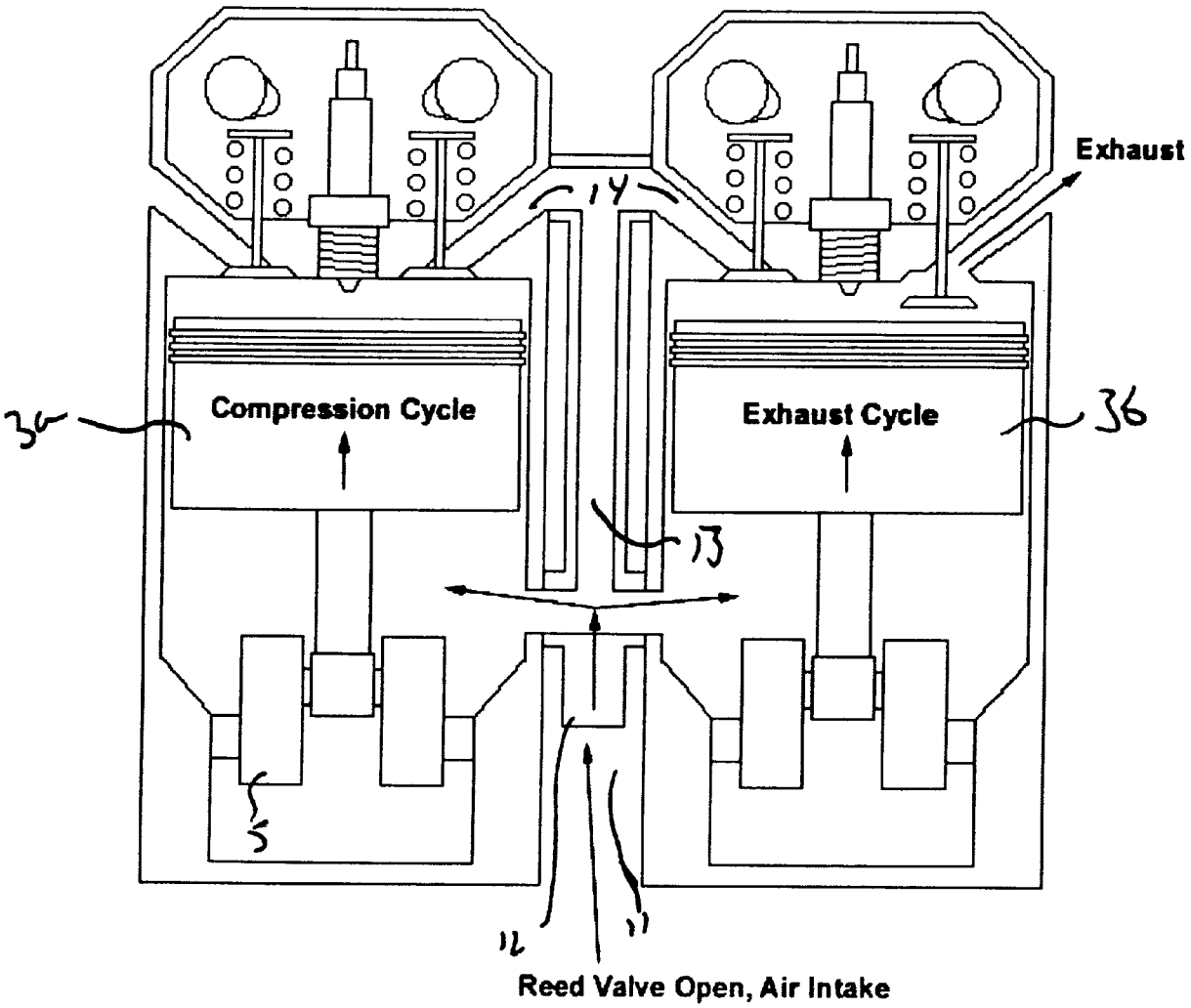
FIG. 3 is a cross-sectional front view of a pair of cylinders showing the pistons moving upward as part of the compression and exhaust cycles.

FIG. 3 shows the upward cycle of the pistons. Here, piston chamber 2*a* is in compression and piston chamber 2*b* is in exhaust. As before, the reed valve opens and a volume of air fills the crankcase chamber.

Figure 4:
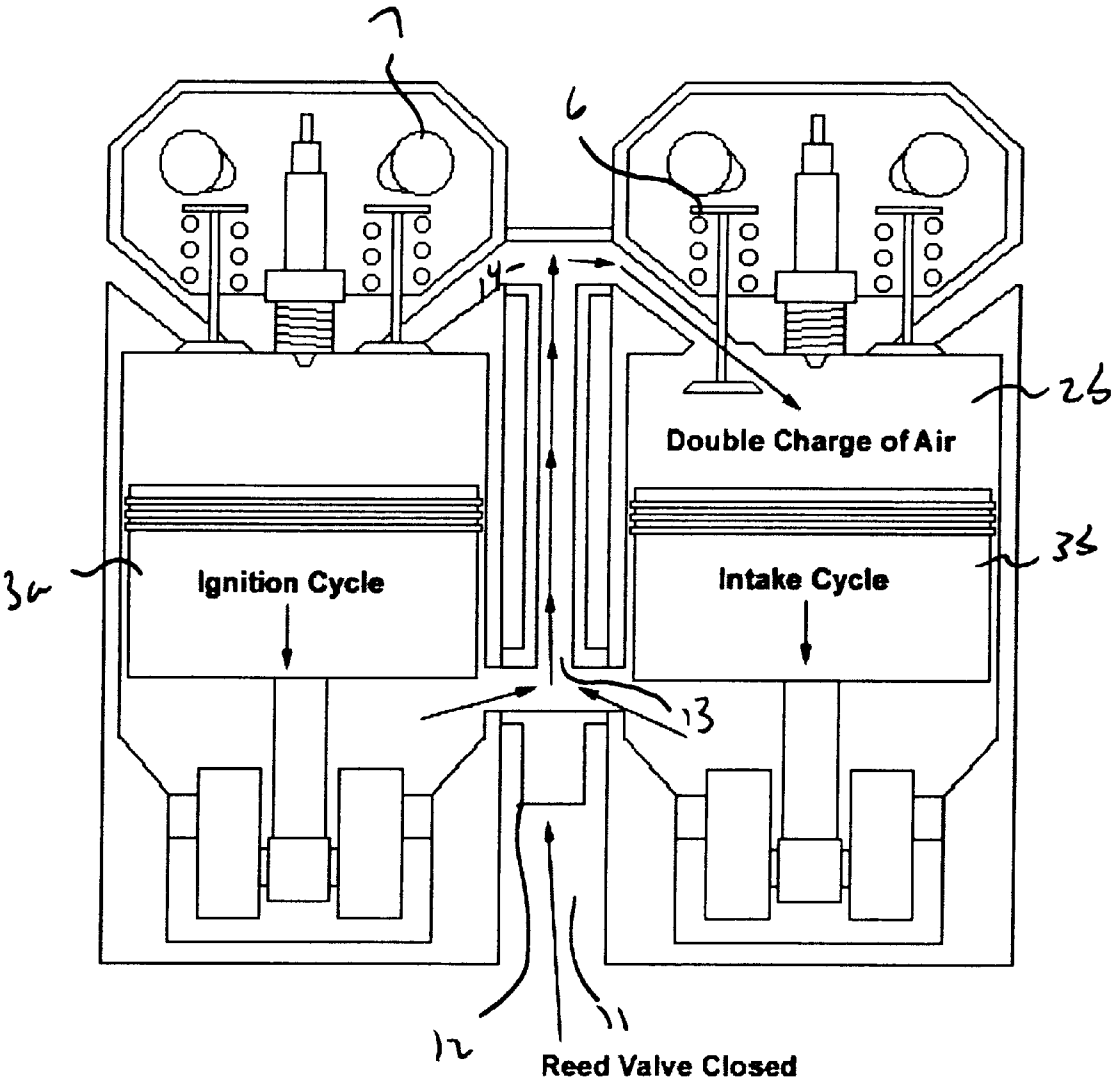
FIG. 4 is a cross-sectional front view of a pair of cylinders showing the pistons moving downward as part of the ignition and intake cycles.

Finally, FIG. 4 shows the next downward cycle, with piston chamber 2*a* having fired and is in the power stroke. Piston chamber 2*b* is in the intake stroke. As the pistons move downward, they compress the air in the crankcase chamber and, because the intake valve of piston chamber 2*b* is opened, they force the entire volume of air from the crankcase chamber into piston chamber 2*b*. This produces a double charge of air in piston chamber 2*b*. As shown, the reed valve is closed during this cycle.

This cycle is then repeated as the engine runs.

Figure 6:
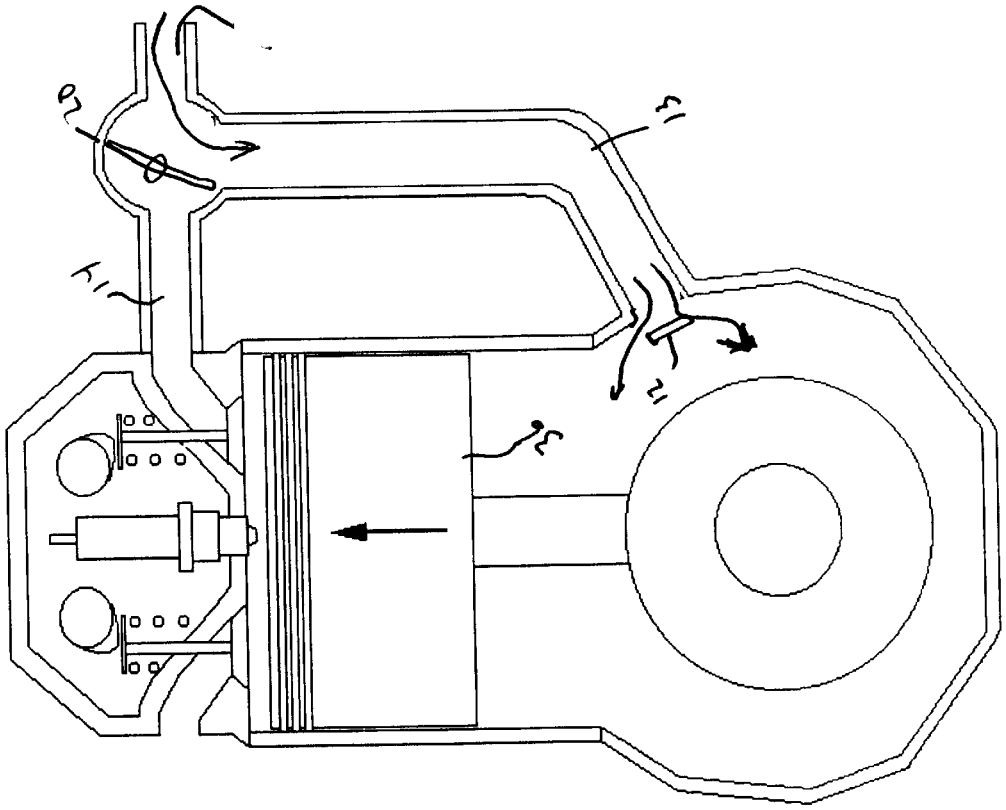
FIG. 6 is a cross-sectional side view of one of the cylinders showing the optional air control valve set in the supercharged mode during the crankcase filling stroke.
Figure 5:
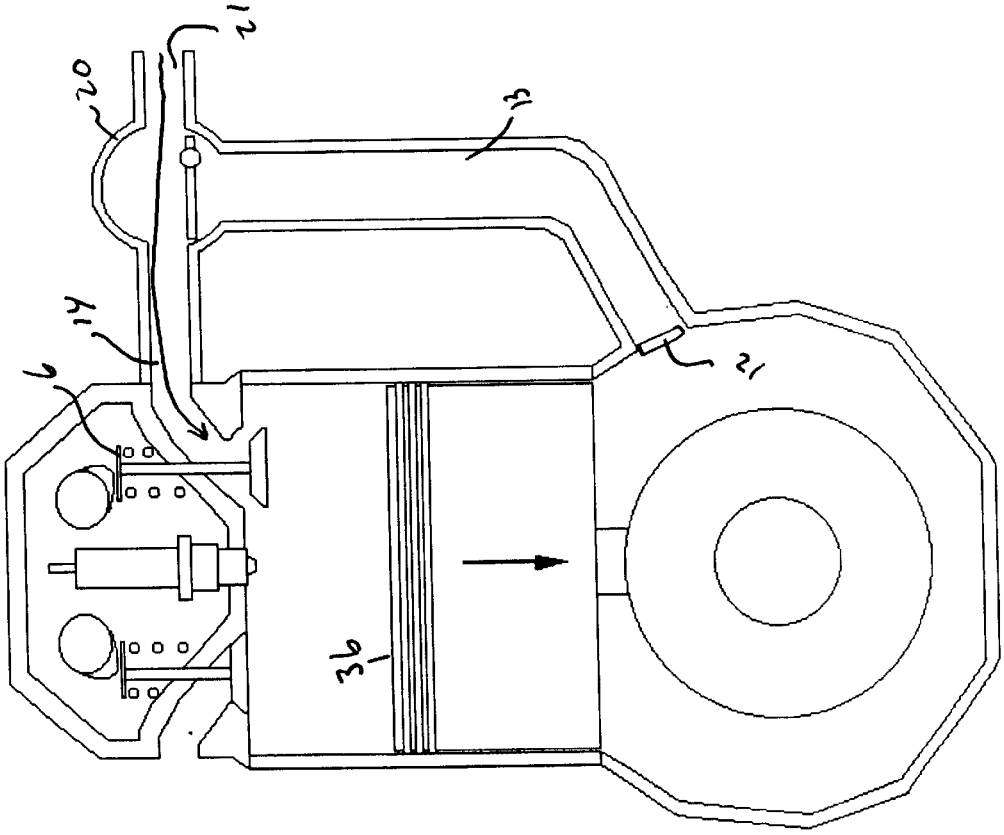
FIG. 5 is a cross-sectional side view of one of the cylinders showing the optional air control valve set in the naturally aspirated mode.
Figure 7:
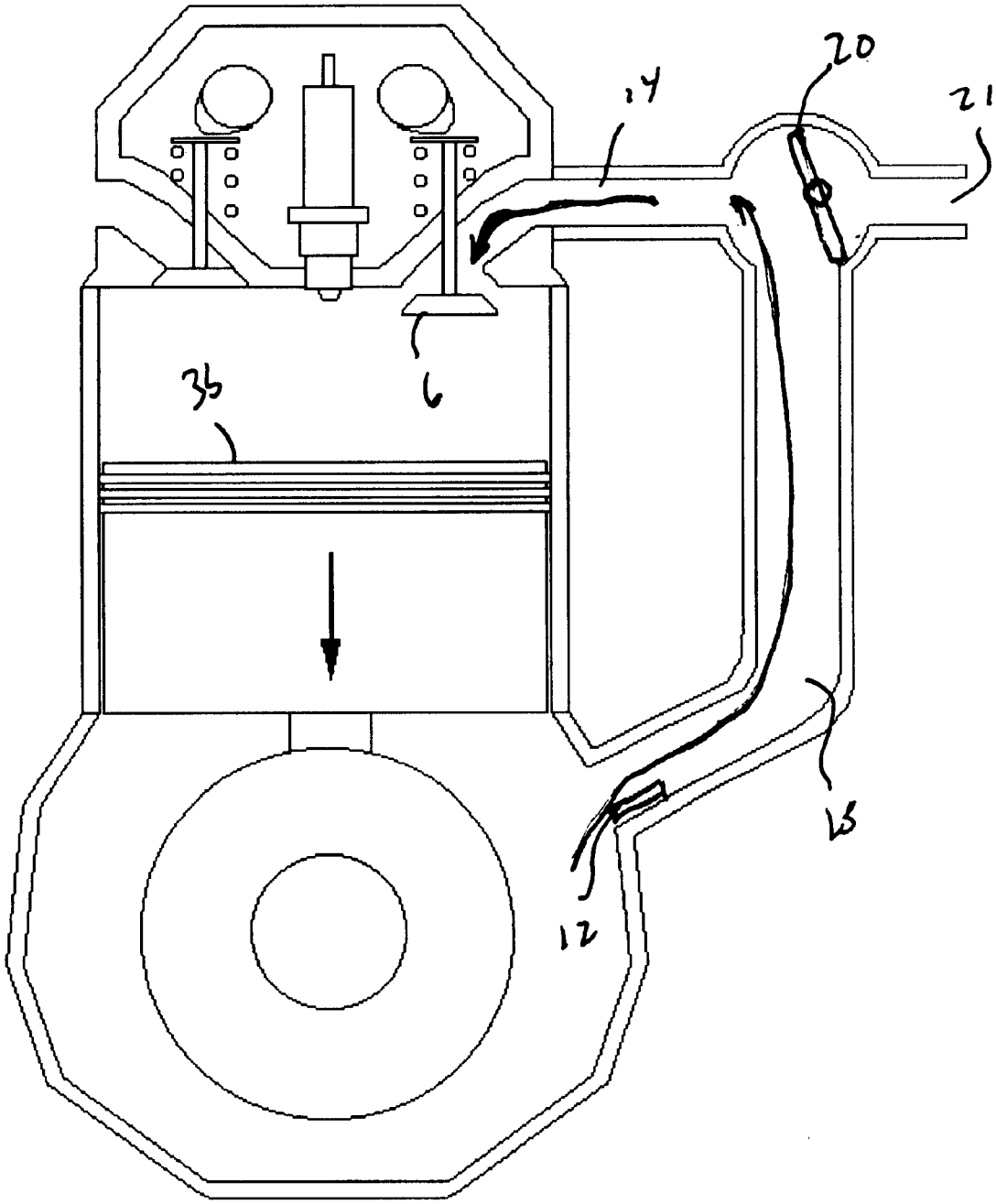
FIG. 7 is a cross-sectional side view of one of the cylinders showing the optional air control valve set in the supercharged mode in the air intake stroke.

FIGS. 5–7 show a second embodiment of the invention. In this embodiment, a valve 20 is inserted into the intake line as shown. FIG. 5 shows the condition wherein the engine runs in a naturally aspirated manner. Here, the valve 20 is used to close the inlet tube 13 so that all of the intake air is directed into the cylinder from the intake manifold 21.

FIGS. 6 and 7 show the system in a supercharge mode. In FIG. 6, the valve opens the inlet tube 13. On the upstroke of the cylinder pair, air is pulled into the crankcase through the valve 20 and the open reed valve 12 as shown.

FIG. 7 shows the intake stroke for the supercharged mode in the second embodiment. Here, the double charge of air in the crankcase is moved through the open reed valve 12 through the inlet tube 13 and into the cylinder. Note that the valve 20 is open to the intake tube 13 to permit the flow into the cylinder.

The position of valve 20 can be set manually, or can be controlled electrically. Moreover, the valve 20 may also be controlled by a computer to adjust the operation of the engine to match the operating conditions being experienced.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A crankcase inducted self-supercharging four-cycle internal combustion engine comprising:

a) at least one cylinder pair having two pistons arranged in a 360-degree crank throw, whereby both pistons in said cylinder pair rise and fall together, each piston being operably installed in a cylinder;

b) a crankcase, operably attached to said cylinder pair, said crankcase having an inlet port and an outlet port;

c) a means for drawing a quantity of air into said crankcase on the upstroke of the pistons;

e) a means for injecting said quantity of air from said crankcase into one of the cylinders of said cylinder pair;

f) an intake manifold, attached to said cylinder pair; and g) a two-way valve operably installed in said intake manifold, wherein when said two-way valve is in a first position, the cylinder pair is naturally aspirated, and when said two-way valve is in said second position, air entering into said intake manifold is directed into said crankcase.

2. The engine of claim 1 wherein the means for drawing air into said crankcase comprises: a two-cycle reed valve, installed on the inlet port of said crankcase.

3. The engine of claim 1 wherein the cylinders in said cylinder pair operate on alternate ignition cycles, whereby when one cylinder is in the power stroke, the other cylinder in said cylinder pair is in the intake stroke.

4. A crankcase inducted self-supercharging four-cycle internal combustion engine comprising:

a) at least one cylinder pair having two pistons arranged in a 360-degree crank throw, whereby both pistons in said cylinder pair rise and fall together, wherein each of said pistons is operably installed in a single cylinder within said cylinder pair;

b) a crankcase, operably attached to said cylinder pair, said crankcase having an inlet port and an outlet port;

c) a two-cycle reed valve, installed on the inlet port of said crankcase, to draw a quantity of air into a crankcase on the upstroke of the pistons;

d) a means for injecting said quantity of air onto one of said cylinders in said cylinder pair on an alternating basis, such that in one cycle, a first cylinder in said cylinder pair receives the quantity of air and on the next cycle, a second cylinder in said cylinder pair receives the quantity of air;

e) an intake manifold, attached to said cylinder pair; and f) a two-way valve operably installed in said intake manifold, wherein when said two-way valve is in a first position, the cylinder pair is naturally aspirated, and when said two-way valve is in said second position, air entering into said intake manifold is directed into said crankcase.

5. The engine of claim 4 wherein the volume of said crankcase is two times the volume of a volume of air normally occupying one of said single cylinders.

6. A method of self-supercharging a four-cycle internal combustion engine having at least one cylinder pair having two pistons arranged in a 360-degree crank throw, whereby both pistons in said cylinder pair rise and fall together, wherein each of said pistons is operably installed in a single cylinder within said cylinder pair; a crankcase, operably attached to said cylinder pair, said crankcase having an inlet port and a outlet port; and a two-cycle reed valve, installed on the inlet port of said crankcase, to draw air into a crankcase on the upstroke of the pistons, an intake manifold, attached to said cylinder pair; and a two-way valve operably installed in said intake manifold; comprising the steps of:

a) drawing a quantity of air equal to two volumes of air into said crankcase through said inlet port on a first upstroke of said pistons;

b) moving the double volume quantity air in said crankcase from said crankcase into a first cylinder in said cylinder pair on a first downstroke of said pistons;

c) drawing a second quantity of air into said crankcase equal to two volumes of air in a second upstroke;

d) moving the double volume quantity air in said crankcase from said crankcase into a second cylinder in said cylinder pair on a second downstroke of said pistons; and e) repeating steps a, b, c, and d for each subsequent cycle of operation;

f) setting the two-way valve is in a first position; and g) drawing a quantity of intake air directly into the cylinder through said intake manifold.

7. The method of claim 6 further comprising the steps of:

a) setting the two-way valve is in said second position;

b) drawing a quantity of intake air into said crankcase, wherein said quantity of air is equal to a double volume of intake air; and c) moving said quantity of intake air into one cylinder in said cylinder pair.

* * * * *